US009555299B2

(12) United States Patent
Nakamura et al.

(10) Patent No.: US 9,555,299 B2
(45) Date of Patent: Jan. 31, 2017

(54) IRON-TYPE GOLF CLUB HEAD

(71) Applicant: Dunlop Sports Co. Ltd., Kobe-shi, Hyogo (JP)

(72) Inventors: Takashi Nakamura, Kobe (JP); Takahiro Norimura, Kobe (JP)

(73) Assignee: DUNLOP SPORTS CO. LTD., Kobe-shi, Hyogo (JP)

( * ) Notice: Subject to any disclaimer, the term of this patent is extended or adjusted under 35 U.S.C. 154(b) by 0 days.

(21) Appl. No.: 14/970,059

(22) Filed: Dec. 15, 2015

(65) Prior Publication Data

US 2016/0184665 A1 Jun. 30, 2016

(30) Foreign Application Priority Data

Dec. 25, 2014 (JP) ..... 2014-263139

(51) Int. Cl.
*A63B 53/04* (2015.01)

(52) U.S. Cl.
CPC ..... *A63B 53/047* (2013.01); *A63B 2053/0491* (2013.01)

(58) Field of Classification Search
CPC ..... A63B 53/04
See application file for complete search history.

(56) References Cited

U.S. PATENT DOCUMENTS

| | | | | |
|---|---|---|---|---|
| 6,290,609 | B1 * | 9/2001 | Takeda | A63B 53/047 473/335 |
| 7,393,287 | B2 * | 7/2008 | Huang | A63B 53/04 473/329 |
| 7,811,179 | B2 * | 10/2010 | Roach | A63B 53/04 473/335 |
| 2006/0035721 | A1 * | 2/2006 | Knutson | A63B 53/047 473/335 |
| 2013/0344988 | A1 | 12/2013 | Hettinger et al. | |

FOREIGN PATENT DOCUMENTS

| | | | |
|---|---|---|---|
| JP | 9-253248 | A | 9/1997 |
| JP | 10-295861 | A | 11/1998 |
| JP | 2014-410 | A | 1/2014 |

* cited by examiner

*Primary Examiner* — Michael Dennis
(74) *Attorney, Agent, or Firm* — Birch, Stewart, Kolasch & Birch, LLP

(57) ABSTRACT

An iron-type golf club head comprises an upper heel-side region having a specific gravity ρ1, a lower heel-side region having a specific gravity ρ2, an upper middle region having a specific gravity ρ3, a lower middle region having a specific gravity ρ4, an upper toe-side region having a specific gravity ρ5 and a lower toe-side region having a specific gravity ρ6 which satisfy the following conditions: ρ1<ρ2, ρ3<ρ4, ρ5<ρ6, ρ4<ρ2, ρ4<ρ6, ρ3<ρ1, and ρ3<ρ5. These six regions are sectioned by a horizontal plane, a toe-side vertical plane and a heel-side vertical plane.

12 Claims, 7 Drawing Sheets

IRON-TYPE GOLF CLUB HEAD

TECHNICAL FIELD

The present invention relates to a golf club head, more particularly to an iron-type golf club head having increased moment of inertia and a lowered center of gravity.

BACKGROUND ART

In recent years, an iron-type golf club head having large moment of inertia around a vertical axis passing though the center of gravity of the club head has been proposed.
(cf. The Following Patent Document 1)
Such club head is hard to rotate around the vertical axis even if a ball hits at a position off the center of the club face toward the toe or heel, therefore, directionality of the hit ball is improved.

Further, an iron-type golf club head having a lowered center of gravity of the club head has been proposed.
(cf. The Following Patent Document 2 and 3)
Such club head increases a chance to hit a ball at a position on the upper side of the sweet spot of the club face.

If a ball is hit at a position on the upper side of the sweet spot, the club head is rotated by a very small angle so as to increase the loft angle, therefore, the launch angle of the ball becomes increased. Thus, for the iron-type golf club head having a lowered center of gravity of the club head, it is easy to hit a golf ball high in the air. This helps to increase the carry.

Accordingly, an iron-type golf club head having high moment of inertia and a lowered center of gravity can improve the carry and directionality of the hit ball.

[Patent document 1] Japanese Patent Application Publication No. H09-253248

[Patent document 2] Japanese Patent Application Publication No. H10-295861

[Patent document 3] Japanese Patent Application Publication No. 2014-000410

SUMMARY OF THE INVENTION

Problems to be Resolved by the Invention

However, if an iron-type golf club head is increased in the moment of inertia around the vertical axis passing though the center of gravity of the club head, the head has a tendency to heighten the position of the center of gravity of the head.

The inventors found that it is possible to achieve high moment of inertia and a lowered center of gravity at the same time by defining specific gravities (average specific gravities) of six regions of the iron-type golf club head specifically in relation to each other, and
a primary object of the present invention is to provide an iron-type golf club head which has high moment of inertia and a lowered center of gravity of the club head at the same time

Means of Solving the Problems

According to the present invention, an iron-type golf club head comprises an upper heel-side region having an average specific gravity $\rho 1$, a lower heel-side region having an average specific gravity $\rho 2$, an upper middle region having an average specific gravity $\rho 3$, a lower middle region having an average specific gravity $\rho 4$, an upper toe-side region having an average specific gravity $\rho 5$ and a lower toe-side region having an average specific gravity $\rho 6$ which satisfy the following conditions (1) to (7):

$$\rho 1<\rho 2 \quad (1)$$

$$\rho 3<\rho 4 \quad (2)$$

$$\rho 5<\rho 6 \quad (3)$$

$$\rho 4<\rho 2 \quad (4)$$

$$\rho 4<\rho 6 \quad (5)$$

$$\rho 3<\rho 1 \quad (6)$$

$$\rho 3<\rho 5 \quad (7)$$

and which regions are sectioned by an upper horizontal plane, a toe-side vertical plane and a heel-side vertical plane, wherein in a standard state of the club head set on a horizontal plane at a lie angle and a loft angle specified for the club head, the upper horizontal plane is positioned 17 mm above the horizontal plane,
the toe-side vertical plane extends parallel with a front-back direction of the club head at a position 15 mm toward the toe from a club face center, and
the heel-side vertical plane extends parallel with a front-back direction of the club head at a position 15 mm toward the heel from the club face center.

Here, the club face center (Fc) is a center of the club face in the toe-heel direction of the club head.

The lower heel-side region having the average specific gravity $\rho 2$ and the lower toe-side region having the average specific gravity $\rho 6$ may satisfy the following condition (8):

$$\rho 6>\rho 2 \quad (8).$$

The mass w1 of the upper heel-side region, the mass w2 of the lower heel-side region, the mass w3 of the upper middle region, the mass w4 of the lower middle region, the mass w5 of the upper toe-side region and the mass w6 of the lower toe-side region may satisfy the following conditions (9) to (14):

$$w3<w4 \quad (9)$$

$$w5<w6 \quad (10)$$

$$w4<w2 \quad (11)$$

$$w4<w6 \quad (12)$$

$$w3<w1 \quad (13)$$

$$w3<w5 \quad (14).$$

The mass w1 of the upper heel-side region and the mass w2 of the lower heel-side region may satisfy the following condition (15):

$$w1-w2<1 \text{ gram} \quad (15)$$

The iron-type golf club head may be composed of a head main body and a weight member fixed to the head main body, wherein the head main body is provided in a sole with a groove-like depression extending in a toe-heel direction, and
the weight member is mounted in the groove-like depression.

The weight member may include
a toe-side weight member mounted in a toe-side part of the groove-like depression, a heel-side weight member mounted in a heel-side part of the groove-like depression, and a sole cover weight member fitted to the groove-like depression so as to cover the toe-side weight member and the heel-side weight member.

The sole cover weight member may have a specific gravity more than a specific gravity of the head main body. Each of the toe-side weight member and the heel-side weight member may have a specific gravity more than the specific gravity of the sole cover weight member.

The specific gravity of the toe-side weight member may be more than the a specific gravity of the heel-side weight member.

The sole cover weight member may be welded to the head main body. The toe-side weight member and the heel-side weight member may be secured therebetween without being welded to the head main body and the sole cover weight member.

The sole cover weight member may be composed of a toe-side thin-walled portion located below the toe-side weight member, a heel-side thin-walled portion located below the heel-side weight member, and a central thick-walled portion located therebetween.

According to the present invention, therefore, the iron-type golf club head can achieve both of high moment of inertia and a lowered center of gravity of the club head at the same time.

DESCRIPTION OF THE PREFERRED EMBODIMENTS

Embodiments of present invention will now be described in detail in conjunction with accompanying drawings.

Figure 1:
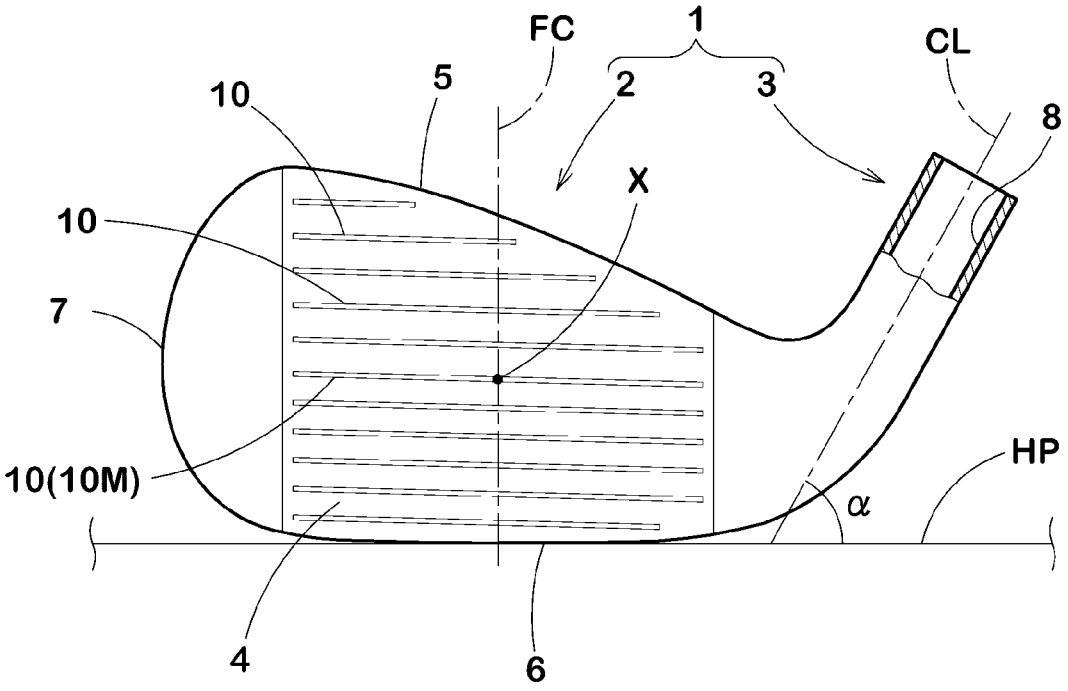
FIG. 1 is a front view of an iron-type golf club head as an embodiment of the present invention under its standard state.

In FIG. 1, there is shown a front view of an iron-type golf club head 1 as an embodiment of the present invention (hereinafter, simply referred to as the club head) under its standard state.

Figure 2:
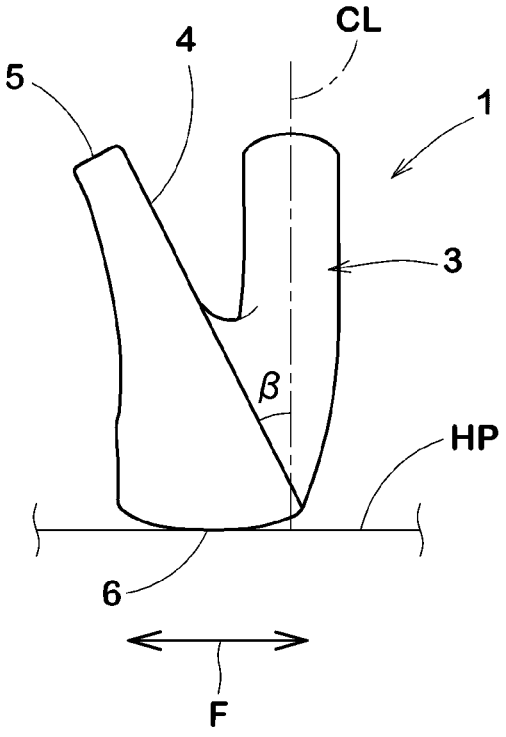
FIG. 2 is a side view of the iron-type golf club head viewed from the toe side toward the heel side of the club head.

FIG. 2 is a side view of the club head 1 shown in FIG. 1 viewed from its toe side.

Here, the standard state of a club head means a state of the club head which is set on a horizontal plane HP at a lie angle alpha and a loft angle beta specified for the club head, while the center line CL of a club shaft to which the club head 1 is attached is kept within a vertical plane.

Unless otherwise noted, the club head 1 should be considered as being under its standard state.

Incidentally, the specified lie angle for the club head 1 is the angle intended between the horizontal plane HP and the center line CL of a club shaft to which the club head 1 is attached. The specified loft angle for the club head 1 is the angle intended between the club face 4 and a vertical plane.

The club head 1 comprises a main portion 2 and a hosel portion 3.

The main portion 2 has a club face 4, a top 5, a sole 6 and a toe 7

The club face 4 is a substantially flat surface for hitting a ball. The club face 4 is provided with impact area markings such as score lines 10.

The club face center FC (the center of the club face 4 in the toe-heel direction) can be defined by a vertical plane extending parallel with the front-back direction of the club head passing through the midpoint X of the longest score line 10M.

The top 5 is an upper surface of the club head 1 extending backward of the club head from the upper edge of the club face 4.

The sole 6 is a bottom face of the club head 1 extending backwardly of the club head from the lower edge of the club face 4.

The toe 7 is a part being farthest from the hosel portion 3 and smoothly connecting between the top 5 and the sole 6.

The hosel portion 3 is a tubular portion provided with a shaft inserting hole 8 into which a club shaft (not shown) is inserted.

Figure 3:
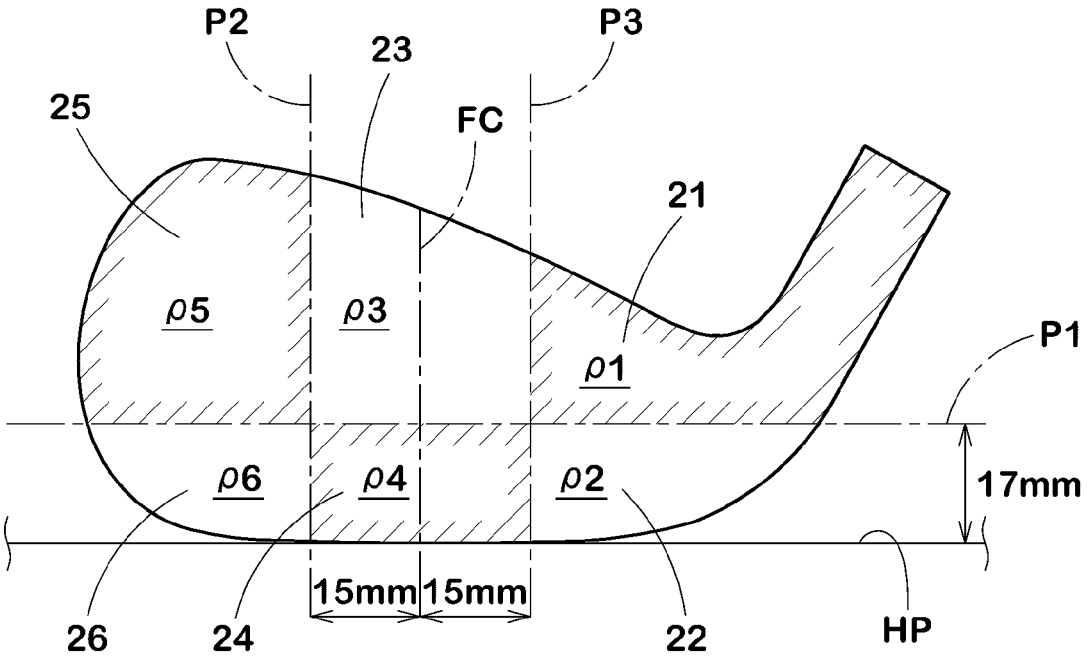
FIG. 3 is a diagram for explaining the six regions of the iron-type golf club head sectioned by the upper horizontal plane, the toe-side vertical plane and the heel-side vertical plane.

When the club head 1 is sectioned into six regions as shown in FIG. 3, average specific gravities of the respective six regions are specially mutuality defined.

As shown in FIG. 3, the six regions are sectioned by three planes: an upper horizontal plane P1, a toe-side vertical plane P2 and a heel-side vertical plane P3.

The upper horizontal plane P1 is positioned 17 mm above the horizontal plane HP.

The reason for 17 mm is that a proper ball hitting position (height) of the iron-type golf club head 1 is about 17 mm from the base of the head.

The toe-side vertical plane P2 is positioned at a distance of 15 mm toward the toe from the club face center FC and extends in parallel with the front-back direction of the club head.

The heel-side vertical plane P3 is positioned at a distance of 15 mm toward the heel from the club face center FC and extends in parallel with the front-back direction of the club head. The reason for 15 mm is that ball hitting positions of the average golfers almost fall within a range between 15 mm toward the toe and 15 mm toward the heel from the club face center FC.

Incidentally, the front-back direction of the club head is a direction F (shown in FIG. 2) perpendicular to the above-mentioned vertical plane within which the shaft center line CL is kept under the standard state of the club head.

By the three planes P1, P2 and P3, the club head 1 under the standard state is sectioned into six regions: an upper heel-side region 21, a lower heel-side region 22, an upper middle region 23, a lower middle region 24, an upper toe-side region 25 and a lower toe-side region 26 as shown in FIG. 3.

The average specific gravity $\rho 1$ of the upper heel-side region 21, the average specific gravity $\rho 2$ of the lower heel-side region 22, the average specific gravity $\rho 3$ of the upper middle region 23, the average specific gravity ρ4 of the lower middle region 24, the average specific gravity ρ5 of the upper toe-side region 25 and the average specific gravity ρ6 of the lower toe-side region 26 satisfy the following conditions (1) to (7):

$$\rho1<\rho2 \quad (1)$$

$$\rho3<\rho4 \quad (2)$$

$$\rho5<\rho6 \quad (3)$$

$$\rho4<\rho2 \quad (4)$$

$$\rho4<\rho6 \quad (5)$$

$$\rho3<\rho1 \quad (6)$$

$$\rho3<\rho5 \quad (7).$$

The average specific gravity of a region is:
if the region is made of one kind of a material, just the specific gravity of the material, and
if the region is made of two or more kinds of materials, the weighted average of the specific gravities of the materials which are weighted by the respective volumes of the materials. By the conditions (1), (2) and (3), the average specific gravity ρ1 of the upper heel-side region 21 becomes less than the specific gravity ρ2 of the lower heel-side region 22, the average specific gravity ρ3 of the upper middle region 23 becomes less than the average specific gravity ρ4 of the lower middle region 24, and the average specific gravity ρ5 of the upper toe-side region 25 becomes less than the average specific gravity ρ6 of the lower toe-side region 26.

Thereby, the club head 1 is relatively easily reduced in the weight on the upper side of the upper horizontal plane P1, and more mass is distributed on the under side of the upper horizontal plane P1. This helps to lower the height of the center of gravity of the club head 1.

By the conditions (4), (5), (6) and (7), the average specific gravity ρ4 of the lower middle region 24 becomes less than the average specific gravity ρ2 of the lower heel-side region 22 and less than the average specific gravity ρ6 of the lower toe-side region 26, and the average specific gravity ρ3 of the upper middle region 23 becomes less than the average specific gravity ρ1 of the upper heel-side region 21 and less than the average specific gravity ρ5 of the upper toe-side region 25.

Thereby, the club head 1 is reduced in the weight in the middle region between the toe-side vertical plane P2 and the heel-side vertical plane P3, and more mass can be distributed on the toe side of the toe-side vertical plane P2 and on the heel side of the heel-side vertical plane P3.

Therefore, the club head 1 is provided with an increased moment of inertia, and can be improved in the directionality of a hit ball.

In this specification, the expression "moment of inertia" means a moment of inertia around a vertical axis passing though the center of gravity of the club head unless otherwise noted.

Preferably, the club head 1 satisfies the following condition (8):

$$\rho6>\rho2 \quad (8).$$

The hosel portion 3 of the club head 1 provides a relatively large mass at a relatively high position in a heel side part of the club head. At the same time, by the condition (8), the lower toe-side region 26 positioned on the opposite side of the hosel portion 3 has the average specific gravity ρ6 more than the average specific gravity ρ2 of the lower heel-side region 22. Therefore, it is possible to effectively increase the moment of inertia, while achieving the lowering of the center of gravity of the club head 1.

Preferably, the difference between the two specific gravities in each of the conditions (1) to (8) is set to be not less than 0.5. Thereby, it becomes possible to obtain an effective weight distribution capable of achieving a further lowered center of gravity and further increased moment of inertia.

Further, in this embodiment, the average specific gravities ρ1 to ρ6 of the six regions satisfy the following condition:

$$\rho3<\rho5<\rho4<\rho1<\rho2<\rho6.$$

The average specific gravity ρ3 of the upper middle region 23 which is smallest in the average specific gravities of the six regions is preferably set in a range of less than 6.0, more preferably not more than 5.8, still more preferably not more than 5.5.

The average specific gravity ρ6 of the lower toe-side region 26 which is the largest in those of the six regions is preferably not less than 9.0, more preferably not less than 9.5, still more preferably not less than 9.8.

For the club head 1 configured as above, it is preferable that
the mass w1 of the upper heel-side region,
the mass w2 of the lower heel-side region,
the mass w3 of the upper middle region,
the mass w4 of the lower middle region,
the mass w5 of the upper toe-side region, and
the mass w6 of the lower toe-side region
satisfy the following conditions (9) to (14):

$$w3<w4 \quad (9)$$

$$w5<w6 \quad (10)$$

$$w4<w2 \quad (11)$$

$$w4<w6 \quad (12)$$

$$w3<w1 \quad (13)$$

$$w3<w5 \quad (14).$$

By satisfying the conditions (1) to (14), the club head 1 can be surely provided with high moment of inertia and a lowered center of gravity.

Further, it is preferable to satisfy the following condition (15):

$$w1-w2<1 \text{ gram} \quad (15).$$

In the conventional iron-type golf club head, w1>w2, and the difference w1−w2≥6 grams.

By satisfying the condition (15), it is possible to distribute more mass to a heel side of the head at a more lowed position. It is more preferable to satisfy w2>w1.

Figure 4:
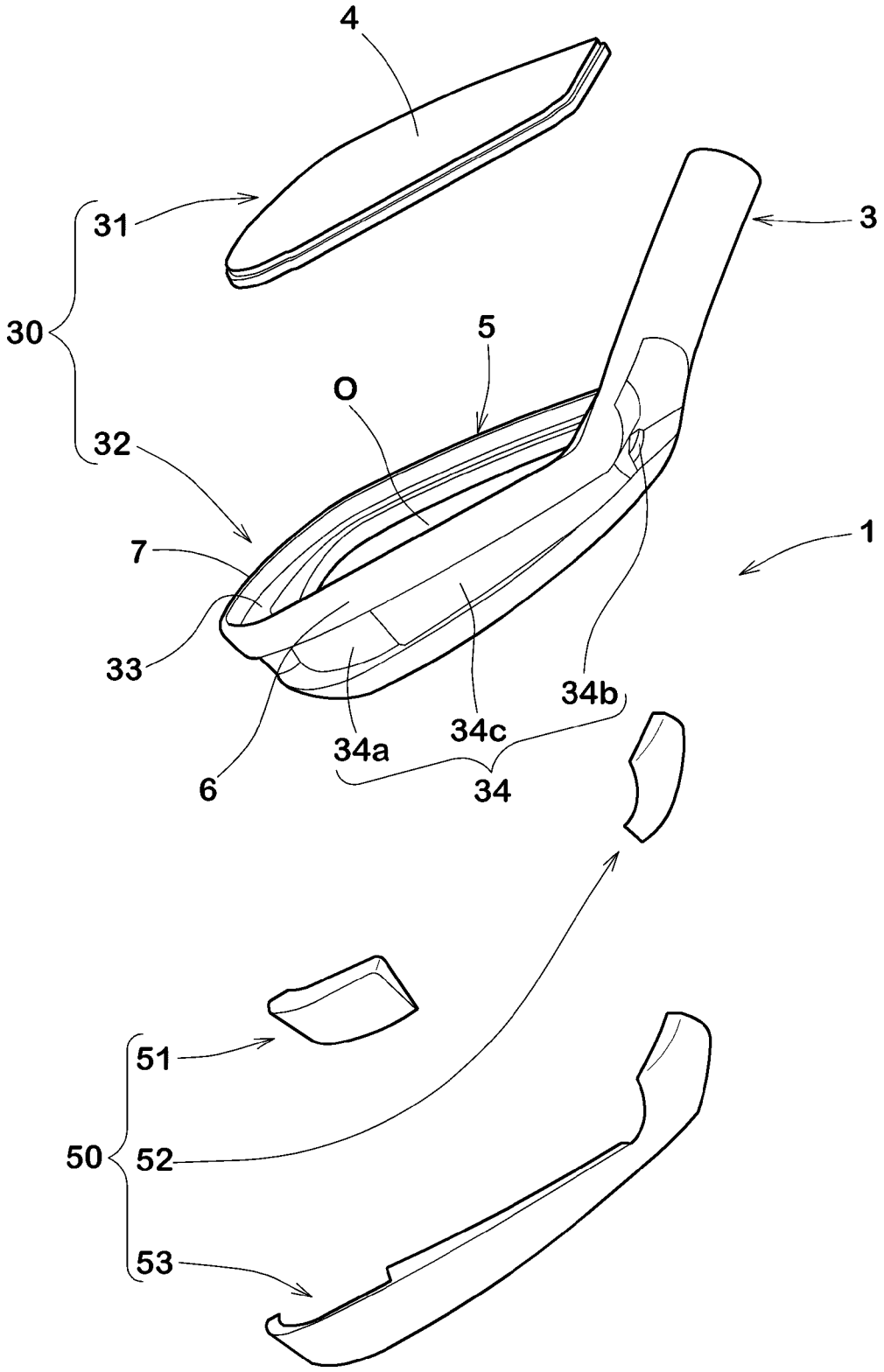
FIG. 4 is an exploded perspective view of the iron-type golf club head showing an example of component parts in this embodiment.

In FIG. 4, there is shown an exemplary structure for the club head 1 capable achieving the above described specific gravity distribution and mass distribution.

In this structure, constructional elements of the club head 1 are a head main body 30 and a weight member 50 fixed to the head main body 30.

The head main body 30 preferably comprises a face plate 31 forming a major part of the club face 4, and a receiving frame 32 on which the face plate 31 is mounted.

The face plate 31 is made of a material having a specific gravity which is the smallest in the constructional elements.

A titanium alloy whose specific gravity is not more than 4.5 can be suitably used for the face plate 31.

The receiving frame 32 in this embodiment has a through-hole penetrating in the front-back direction of the club head and surrounded by the top 5, the sole 6 and the toe 7.

The receiving frame 32 is provided around a front opening O of the through-hole with a club face mounting portion 33 to which a peripheral edge portion of the face plate 31 is fixed.

The front opening O is closed by the face plate 31 fixed to the club face mounting portion 33.

The receiving frame 32 integrally includes the hosel portion 3.

It is preferable that the receiving frame 32 is made of an iron-base alloy having essential strength and good workability. Preferably, stainless steel, carbon steel and the like can be used.

Further, the head main body 30 is provided in the surface of the sole 6 with a groove-like depression 34 extending in the toe-heel direction.

Figure 5:
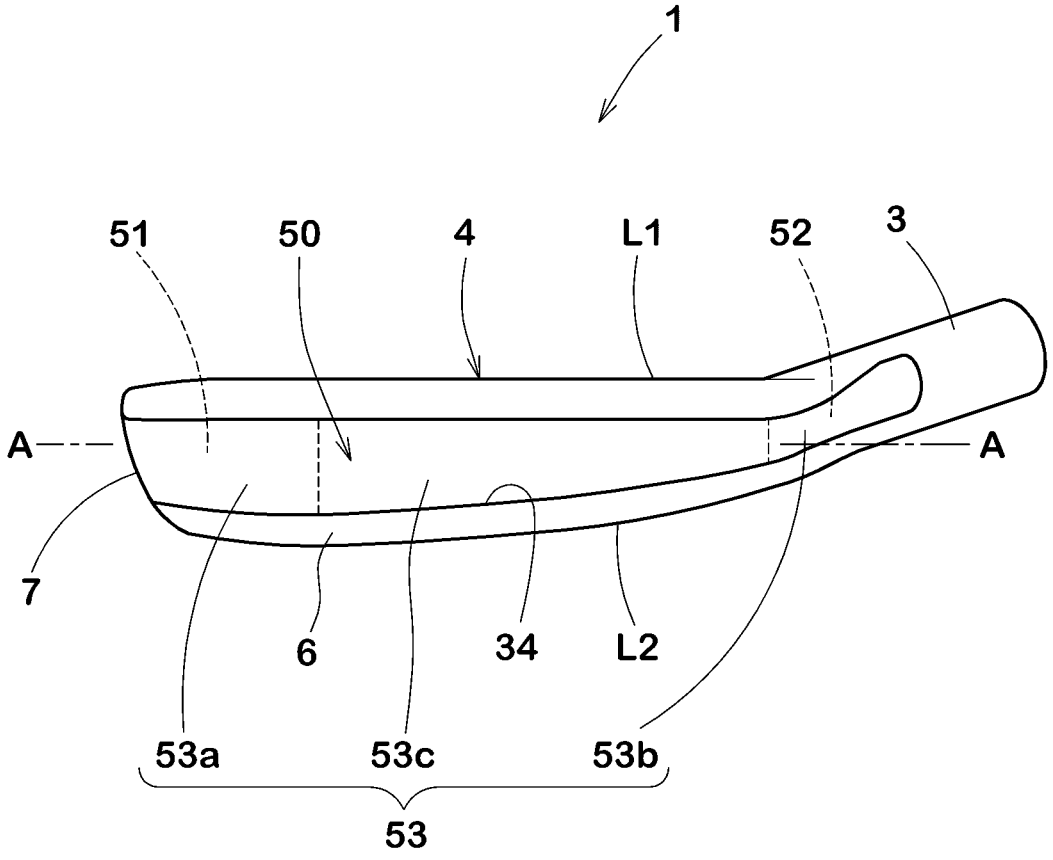
FIG. 5 is a bottom view of the iron-type golf club head under its standard state.

FIG. 5 is a bottom view of the club head 1 under the standard state. As shown in FIG. 4 and FIG. 5, the groove-like depression 34 extends in the toe-heel direction along the sole 6 to have a configuration long in the toe-heel direction.

In this embodiment, the groove-like depression 34 extends over the entire length in the toe-heel direction, of the sole 6, and the toe-side end and the heel-side end of the groove-like depression 34 reach into the toe 7 and the hosel portion 3, respectively.

As shown in FIG. 5, the groove-like depression 34 is disposed within the width between the leading edge L1 and the trailing edge L2 of the head, therefore, the width of in the front-back direction, of the groove-like depression 34 is smaller than the above-mentioned width between the edges L1 and L2.

Figure 6:
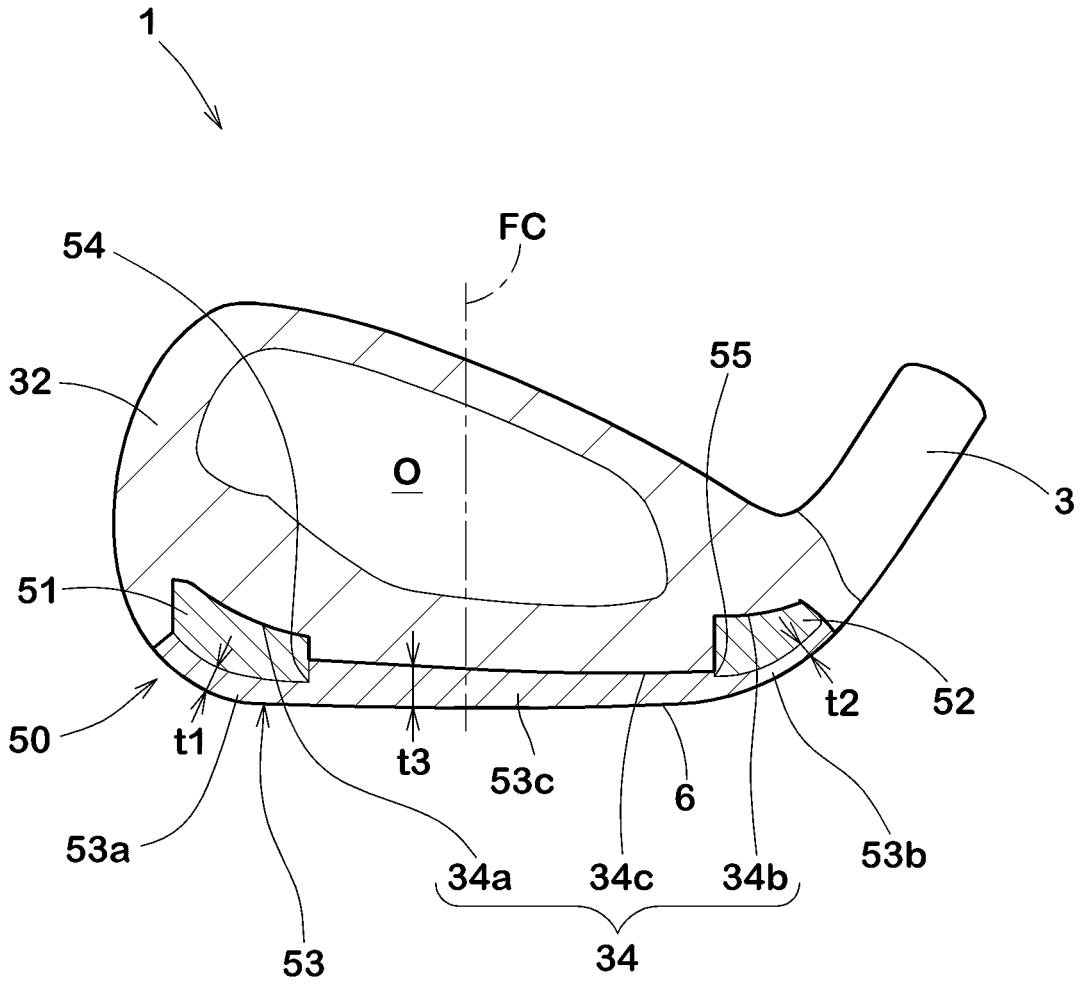
FIG. 6 is a cross sectional view taken along line A-A of FIG. 5.

FIG. 6 is a cross sectional view taken along line A-A of FIG. 5. As shown in FIG. 4 and FIG. 6, the groove-like depression 34 comprises a toe-side depression 34*a*, a heel-side depression 34*b*, and a middle depression 34*c* extending therebetween.

The toe-side depression 34*a* and the heel-side depression 34*b* are dented from the outer surface of the sole 6 more than the middle depression 34*c* as shown in FIG. 6.

The weight member 50 is fixed to the inside of the groove-like depression 34.

In this embodiment, the weight member 50 comprises three components: a toe-side weight member 51, a heel-side weight member 52 and a sole cover weight member 53.

These three components 51, 52 and 53 each have a specific gravity more than the head main body 30 (namely, the face plate 31 and the receiving frame 32 in this embodiment).

The specific gravity of the weight members 50 as a whole is preferably not less than 9.0.

The toe-side weight member 51 is disposed on the toe side of the club face center FC so that a mass is provided in a toe side of the club head 1 in a concentrated manner.

The toe-side weight member 51 has a configuration such that the toe-side weight member 51 can fit into the toe-side depression 34*a* without interspace in substance.

Accordingly, by inserting the toe-side weight member 51 into the toe-side depression 34*a*, the toe-side weight member 51 is substantially prevented from moving in the upper direction, the front-back direction and the toe-heel direction of the club head. The under surface of the toe-side weight member 51 is positioned above the outer surface of the sole 6, namely, positioned within the depression, so as not to form a part of the outer surface of the sole 6. The toe-side weight member 51 is however, not limited to this configuration.

The heel-side weight member 52 is disposed on the heel side of the club face center FC so that a mass is provided in a heel side of the club head 1 in a concentrated manner.

The heel-side weight member 52 has a configuration such that the heel-side weight member 52 can fit into the heel-side depression 34*b* without interspace in substance.

Accordingly, by inserting the heel-side weight member 52 into the heel-side depression 34*b*, the heel-side weight member 52 is substantially prevented from moving in the upper direction, the front-back direction and the toe-heel direction of the club head. The under surface of the heel-side weight member 52 is positioned above the outer surface of the sole 6, namely, positioned within the depression, so as not to form a part of the outer surface of the sole 6. The heel-side weight member 52 is however, not limited to this configuration.

The sole cover weight member 53 extends in the toe-heel direction across the club face center FC.

In this embodiment, the sole cover weight member 53 extends in the toe-heel direction over the entire length of the groove-like depression 34. Thereby, the sole cover weight member 53 in this embodiment is disposed so as to cover the toe-side weight member 51 and the heel-side weight member 52 from the under side (sole side).

It is preferable that each of the toe-side weight member 51 and the heel-side weight member 52 has a specific gravity more than that of the sole cover weight member 53 in order to satisfy the above-mentioned conditions (2), (4) and (5) to obtain a further lowered center of gravity and further increased moment of inertia of the club head.

Further, it is preferable that the toe-side weight member 51 has a specific gravity more than that of the heel-side weight member 52 in order to satisfy the above-mentioned condition (8).

The specific gravity of the toe-side weight member 51 is preferably set in a range of more than 14, more preferably not less than 15, still more preferably not less than 16.

The specific gravity of the heel-side weight member 52 is preferably set in a range of more than 10, more preferably not less than 11, still more preferably not less than 13.

The specific gravity of the sole cover weight member 53 is preferably set in a range of not less than 9 and not more than 10.

In this embodiment, each of the weight members 51, 52 and 53 is made of a heavy metal such as a tungsten-nickel-iron alloy comprising tungsten, nickel and iron.

The specific gravities of the tungsten-nickel-iron alloys as the weight members 51, 52 and 53 can be adjusted by changing the content of the tungsten. For example, by increasing the content of the tungsten, the specific gravity is increased.

In this embodiment, the alloy of each of the toe-side weight member 51 and the heel-side weight member 52 comprises a larger content of tungsten than the alloy of the sole cover weight member 53 to thereby has a specific gravity more than that of the sole cover weight member 53.

By increasing the content of tungsten, a tungsten-nickel-iron alloy can be increased in the specific gravity, but the weldability with an iron-base alloy is liable to decrease. Therefore, if a tungsten-nickel-iron alloy with a high tungsten content is used as the toe-side weight member 51 and the heel-side weight member 52, it becomes difficult to firmly weld these weight members 51 and 52 to the head main body 30 made of the iron-base alloy.

Since the sole cover weight member 53 is made of a tungsten-nickel-iron alloy with a relatively low tungsten content than the weight members 51 and 52, it is possible to weld the sole cover weight member 53 to the head main body 30 firmly in comparison with the weight members 51 and 52.

In this embodiment, therefore, the sole cover weight member 53 is welded to the head main body 30 (receiving frame 32).

In contrast, the toe-side weight member 51 and the heel-side weight member 52 are not welded to the receiving frame 32 and also not welded to the sole cover weight member 53.

The toe-side weight member 51 and the heel-side weight member 52 are held within an internal space of the club head defined by the head main body 30 and the sole cover weight member 53 in such a state that the weight members 51 and 52 fit to the internal space without rattling.

Thus, according to such configuration, when the three weight members 51 to 53 are attached to the head main body 30, the toe-side weight member 51 and the heel-side weight member 52 are easily placed in their right positions by simply putting these into the toe-side depression 34*a* and the heel-side depression 34*b*. Then, by merely welding the sole cover weight member 53 to the head main body 30, the three weight members 51 to 53 are firmly secured in the groove-like depression 34.

Thus, in the club head 1 in this embodiment, the weight member 50 can be attached to the head main body 30 with less number of processes.

The specific gravity of each of the toe-side weight member 51 and the heel-side weight member 52 is preferably set in a range of not less than 10, more preferably not less than 12, still more preferably not less than 13 in order to obtain further increased moment of inertia and a further lowered center of gravity of the club head.

Preferably, the specific gravity of the sole cover weight member 53 is set in a range of less than 10 in order to achieve strong welding with respect to the head main body 30 made of the iron-base alloy.

Preferably, the sole cover weight member 53 comprises a toe-side thin-walled portion 53*a*, a heel-side thin-walled portion 53*b*, and a central thick-walled portion 53*c* extending therebetween as shown in FIG. 6.

The toe-side thin-walled portion 53*a* of the sole cover weight member 53 is defined as being located beneath the toe-side weight member 51.

The heel-side thin-walled portion 53*b* of the sole cover weight member 53 is defined as being located beneath the heel-side weight member 52.

It is preferable that the toe-side thin-walled portion 53*a* and the heel-side thin-walled portion 53*b* are formed as thin as possible in order that the toe-side weight member 51 and the heel-side weight member 52 can be disposed as low as possible (namely, toward the outer surface of the sole 6) to thereby enable the center of gravity of the club head to be further lowered.

It is especially preferable that the thickness t1 of the toe-side thin-walled portion 53*a* and the thickness t2 of the heel-side thin-walled portion 53*b* are set in a range of not more than 3.0 mm, more preferably not more than 2.5 mm, still more preferably not more than 2.0 mm.

The thickness t3 of the central thick-walled portion 53*c* is more than the thickness t1 of the toe-side thin-walled portion 53*a* and more than the thickness t2 of the heel-side thin-walled portion 53*b*.

Due to the thickness difference, on the upper surface of the sole cover weight member 53, a step 54 is formed at the boundary between the toe-side thin-walled portion 53*a* and the central thick-walled portion 53*c*, and a step 55 is formed at the boundary between the heel-side thin-walled portion 53*b* and the central thick-walled portion 53*c*.

These steps 54 and 55 provide a function of positioning in the toe-heel direction for the toe-side weight member 51 and the heel-side weight member 52 which are not welded and simply put in the groove-like depression 34.

Thereby, undesirable impact or ball hit feeling and sound can be prevented.

Figure 7:
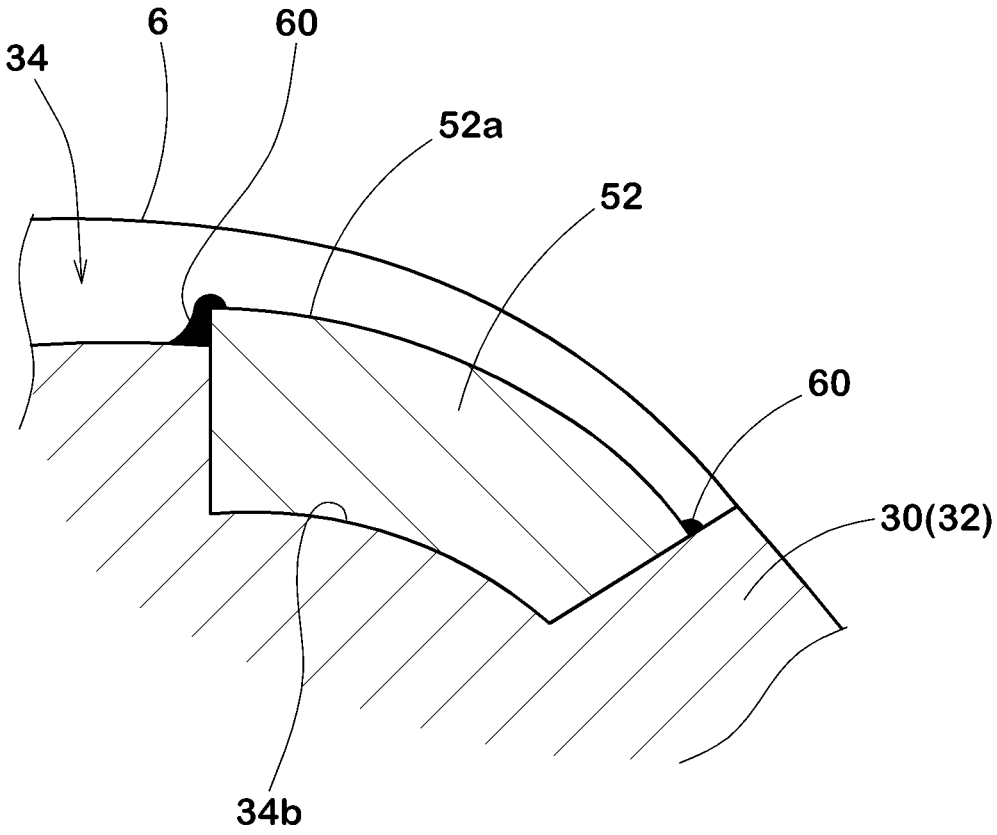
FIG. 7 is an enlarged cross sectional view of a heel-side part of an iron-type golf club head as another embodiment of the present invention.

FIG. 7 shows a heel-side part of an iron-type golf club head as another embodiment of the present invention, wherein the structure of the golf club may be the same as that of the former embodiment excepting this heel-side part.

In FIG. 7, the heel-side part is illustrated upside down such that the outer surface of the sole 6 faces upward.

In this embodiment, in order to further stabilize the position of the heel-side weight member 52, a temporary joint member 60 is used.

The temporary joint member 60 is formed by a hardened molten metal. Preferably, the hardened molten metal is the same as the metal material of the head main body 30 (more specifically the receiving frame 32) or a metal material whose major component is the same as the major component of the metal material of the head main body 30 (more specifically, the receiving frame 32).

After the heel-side weight member 52 is fitted into the heel-side depression 34*b*, the molten metal of a stainless steel for example is applied from point to point along a boundary line between the heel-side weight member 52 and the heel-side depression 34*b*.

It is preferable that, at the applied points, a part of the molten metal reaches to and covers a part of the sole side surface 52*a* of the heel-side weight member 52 as shown in FIG. 7, by being bent into a hook shape. Such molten metal is not always serve for metallic bonding between the heel-side weight member 52 and the head main body 30, but it is integrally fixed to the head main body 30. Therefore, the heel-side weight member is prevented from being displaced toward the sole side. Incidentally, such temporary joint member 60 can be adopted for the toe-side weight member 51 in the same manner as above although not shown in the figure.

While detailed description has been made of preferable embodiments of the present invention, the present invention can be embodied in various forms without being limited to the illustrated embodiments.

WORKING EXAMPLES

Based on the structure shown in FIGS. 1 to 7, an iron-type golf club head was experimentally manufactured.

Figure 8:
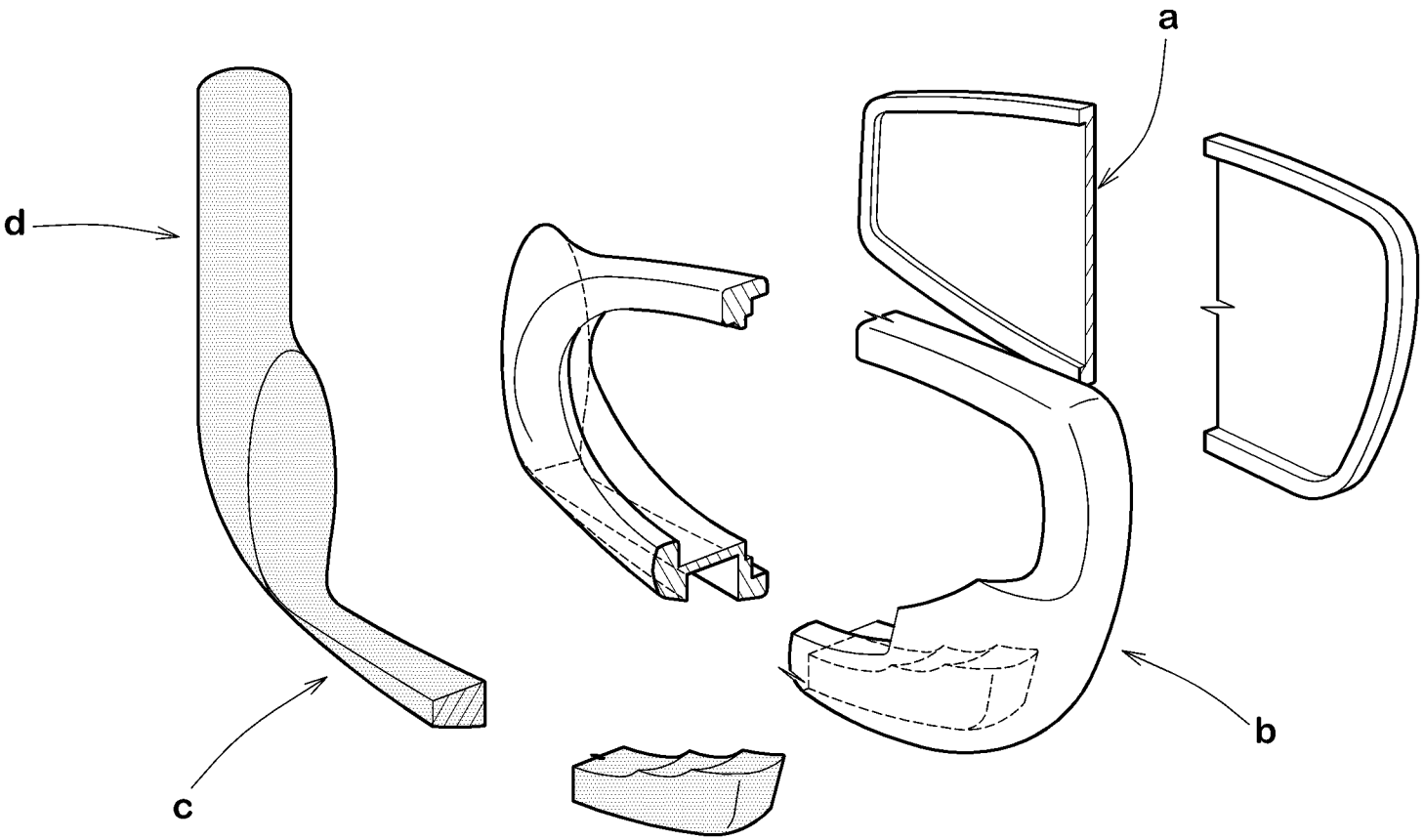
FIG. 8 is an exploded perspective view of an iron-type golf club head according to a prior art.

Further, an iron-type golf club head having the structure shown in FIG. 8 (corresponding to JP2015-027373A or US2015-038263A1) was prepared as Comparative example.

The golf club heads were measured for the moment of inertia and the height of the center of gravity of the club head.

Specifications of the club heads are as follows.

<Common Specifications> club head: for six iron club
lie angle alpha: 61.5 degrees
loft angle beta: 27 degrees

Working Example (FIG. 4)

material of weight members: tungsten-nickel-iron alloys
specific gravity of toe-side weight member: 16 specific gravity of heel-side weight member: 14
specific gravity of sole cover weight member: 9.5
material of face member: titanium alloy (specific gravity: 4.4)
material of club face receiving portion: stainless SUS630 (specific gravity: 7.8)

Comparative Example (FIG. 8)

material of weight member: tungsten-nickel-iron alloy (specific gravity: 9.5)
material of face member: titanium alloy (specific gravity: 4.4)
material of club face receiving portion: stainless SUS630 (specific gravity: 7.8)

<Height of Center of Gravity>

In the standard state of the club head, the vertical distance from the horizontal plane to the center of gravity of the club head was measured as the height of the center of gravity.

<Moment of Inertia>

The moment of inertia around a vertical axis passing though the center of gravity of the club head under the standard state was measured by the use of a moment of inertia measuring instrument, Model No. 005-002, manufactured by INERTIA DYNAMICS Inc.

TABLE 1

| Working example head moment of inertia: 2973 g · sq · cm height of center of gravity: 19.5 mm | | |
|---|---|---|
| upper toe-side region average specific gravity ρ5: 6.19 mass w5: 34.3 g | upper middle region average specific gravity ρ3: 5.40 mass w3: 17.8 g | upper heel-side region average specific gravity ρ1: 7.40 mass w1: 51.0 g |
| lower toe-side region average specific gravity ρ6: 9.91 mass w6: 71.3 g | lower middle region average specific gravity ρ4: 7.25 mass w4: 33.1 g | lower heel-side region average specific gravity ρ2: 7.94 mass w2: 50.2 g |
| **Comparative example moment of inertia: 2969 g · sq · cm height of center of gravity: 20.0 mm** | | |
| upper toe-side region average specific gravity ρ5: 6.27 mass w5: 37.09 g | upper middle region average specific gravity ρ3: 5.37 mass w3: 17.77 g | upper heel-side region average specific gravity ρ1: 8.17 mass w1: 53.05 g |
| lower toe-side region average specific gravity ρ6: 8.11 mass w6: 59.61 g | lower middle region average specific gravity ρ4: 7.70 mass w4: 45.14 g | lower heel-side region average specific gravity ρ2: 7.87 mass w2: 46.28 g |

From the test results, it was confirmed that, in comparison with the club head as comparative example, the club head as working example was decreased in the height of the center of gravity, while maintaining high moment of inertia.

REFERENCE SIGNS LIST

1 iron-type golf club head
2 main portion
3 hosel portion
4 club face
5 top
6 sole
7 toe
21 upper heel-side region
22 lower heel-side region
23 upper middle region
24 lower middle region
25 upper toe-side region
26 lower toe-side region
30 head main body
31 face plate
32 receiving frame
34 groove-like depression
34*a* toe-side depression
34*b* heel-side depression
34*c* middle depression
50 weight member
51 toe-side weight member
52 heel-side weight member
53 sole cover weight member
53*a* toe-side thin-walled portion
53*b* heel-side thin-walled portion
53*c* central thick-walled portion
P1 upper horizontal plane
P2 toe-side vertical plane
P3 heel-side vertical plane

The invention claimed is:

1. An iron-type golf club head comprising
an upper heel-side region having an average specific gravity ρ1,
a lower heel-side region having an average specific gravity ρ2,
an upper middle region having an average specific gravity ρ3,
a lower middle region having an average specific gravity ρ4,
an upper toe-side region having an average specific gravity ρ5 and
a lower toe-side region having an average specific gravity ρ6 which satisfy the following conditions (1) to (7):

$$\rho 1<\rho 2 \quad (1)$$

$$\rho 3<\rho 4 \quad (2)$$

$$\rho 5<\rho 6 \quad (3)$$

$$\rho 4<\rho 2 \quad (4)$$

$$\rho 4<\rho 6 \quad (5)$$

$$\rho 3<\rho 1 \quad (6)$$

$$\rho 3<\rho 5 \quad (7)$$

and which regions are sectioned by an upper horizontal plane, a toe-side vertical plane and a heel-side vertical plane, wherein
in a standard state of the club head set on a horizontal plane at a lie angle and a loft angle specified for the club head, the upper horizontal plane is positioned 17 mm above the horizontal plane,
the toe-side vertical plane extends parallel with a front-back direction of the club head at a position 15 mm toward the toe from a club face center, and
the heel-side vertical plane extends parallel with a front-back direction of the club head at a position 15 mm toward the heel from the club face center.

2. The iron-type golf club head according to claim 1, wherein
the lower heel-side region having the average specific gravity ρ2 and the lower toe-side region having the average specific gravity ρ6 satisfy the following condition (8):

$$\rho 6>\rho 2 \quad (8).$$

3. The iron-type golf club head according to claim 1, wherein a mass w1 of the upper heel-side region, a mass w2 of the lower heel-side region, a mass w3 of the upper middle region, a mass w4 of the lower middle region, a mass w5 of the upper toe-side region and a mass w6 of the lower toe-side region satisfy the following conditions (9) to (14):

$$w3<w4 \quad (9)$$

$$w5<w6 \quad (10)$$

$$w4<w2 \quad (11)$$

$$w4<w6 \quad (12)$$

$$w3<w1 \quad (13)$$

$$w3<w5 \quad (14).$$

4. The iron-type golf club head according to claim 2, wherein a mass w1 of the upper heel-side region, a mass w2 of the lower heel-side region, a mass w3 of the upper middle region, a mass w4 of the lower middle region, a mass w5 of the upper toe-side region and a mass w6 of the lower toe-side region satisfy the following conditions (9) to (14):

$$w3<w4 \quad (9)$$

$$w5<w6 \quad (10)$$

$$w4<w2 \quad (11)$$

$$w4<w6 \quad (12)$$

$$w3<w1 \quad (13)$$

$$w3<w5 \quad (14).$$

5. The iron-type golf club head according to claim 3, wherein the mass w1 of the upper heel-side region and the mass w2 of the lower heel-side region satisfy the following condition (15):

$$w1-w2<1 \text{ gram} \quad (15).$$

6. The iron-type golf club head according to claim 1, which comprises a head main body and a weight member fixed to the head main body, wherein the head main body is provided in a sole with a groove-like depression extending in a toe-heel direction, the weight member is mounted in the groove-like depression, and the weight member includes a toe-side weight member mounted in a toe-side part of the groove-like depression, a heel-side weight member mounted in a heel-side part of the groove-like depression, and a sole cover weight member fitted to the groove-like depression so as to cover the toe-side weight member and the heel-side weight member.

7. The iron-type golf club head according to claim 6, wherein the sole cover weight member has a specific gravity more than a specific gravity of the head main body, and each of the toe-side weight member and the heel-side weight member has a specific gravity more than the specific gravity of the sole cover weight member.

8. The iron-type golf club head according to claim 6, wherein the specific gravity of the toe-side weight member is more than the specific gravity of the heel-side weight member.

9. The iron-type golf club head according to claim 6, wherein the sole cover weight member is welded to the head main body, and the toe-side weight member and the heel-side weight member are secured therebetween without being welded to the head main body.

10. The iron-type golf club head according to claim 6, wherein the sole cover weight member is composed of a toe-side thin-walled portion located below the toe-side weight member, a heel-side thin-walled portion located below the heel-side weight member, and a central thick-walled portion located therebetween.

11. The iron-type golf club head according to claim 7, wherein the sole cover weight member is composed of a toe-side thin-walled portion located below the toe-side weight member, a heel-side thin-walled portion located below the heel-side weight member, and a central thick-walled portion located therebetween.

12. The iron-type golf club head according to claim 8, wherein the sole cover weight member is composed of a toe-side thin-walled portion located below the toe-side weight member, a heel-side thin-walled portion located below the heel-side weight member, and a central thick-walled portion located therebetween.

* * * * *